US005332286A

United States Patent [19]

Atherton et al.

[11] Patent Number: 5,332,286

[45] Date of Patent: Jul. 26, 1994

[54] BOOSTER SEAT APPARATUS

[76] Inventors: Jessica A. Atherton; Ann Atherton, both of 759 Cal Cove Dr., Fort Myers, Fla. 33919; Kimberly S. Brown, 17220 Terraverde Cir., #206, Fort Myers, Fla. 33908

[21] Appl. No.: 958,017

[22] Filed: Oct. 7, 1992

[51] Int. Cl.[5] ..... A47C 1/08

[52] U.S. Cl. ..... 297/256.11; 297/194

[58] Field of Search ..... 297/250, 3, 194, 338, 297/345, 485

[56] References Cited

U.S. PATENT DOCUMENTS

| | | | |
|---|---|---|---|
| D. 230,784 | 3/1974 | Turco | 297/250 |
| 909,453 | 1/1909 | Pullman | 297/194 |
| 1,769,722 | 7/1930 | Sutton | 297/485 |
| 2,285,925 | 6/1942 | Handy | 297/452.23 |
| 2,515,527 | 7/1950 | Robinson | 297/250 |
| 3,259,425 | 7/1966 | Chitwood | 297/232 |
| 3,547,489 | 12/1970 | Grieser | 297/250 |
| 4,463,984 | 8/1984 | Molnar | 297/250 |
| 4,521,052 | 6/1985 | Cone | 297/250 |
| 4,613,048 | 9/1986 | McGill | 297/194 |
| 4,798,412 | 1/1989 | Kohus et al. | 297/250 |
| 4,867,504 | 9/1989 | Johnson, Jr. | 297/250 |
| 4,918,853 | 4/1990 | Bascom et al. | 297/188 |
| 4,968,091 | 11/1990 | Mariol | 297/250 |
| 5,125,717 | 6/1992 | Sköld et al. | 297/250 |
| 5,215,354 | 6/1993 | Grene | 297/485 |

*Primary Examiner*—Peter M. Cuomo

*Assistant Examiner*—Darnell M. Boucher

*Attorney, Agent, or Firm*—William E. Noonan

[57] ABSTRACT

An invertible booster seat apparatus is provided for a chair having a supporting seat and a laterally curved seat back. The booster seat includes a pair of spaced apart side supports, each having a first support portion for engaging the supporting seat and a second support portion for defining an armrest. The side support portions are invertible such that the second support portions engage the supporting seat and the first support portions define armrests. A seat section interconnects the side supports between the first support portions and the second support portions. The seat section has a first seat surface for supporting a person thereon when the first support portions engage the supporting seat and an opposite second seat surface for supporting a person thereon when the second support portions engages the supporting seat. The seat section further has a convexly curved rearward edge portion for engaging the curved seat back of the chair. A substantially fully open first back region is formed adjacent the first seat surface and between the second side support portions for cooperating with the curved seat back of the chair to define a seat back for a person seated on the first seat surface. A substantially fully open second back region is formed adjacent the second seat surface in between the first side support portions for cooperating with the curved seat back of the chair to define a seat back for a person seated on the second seat surface.

11 Claims, 3 Drawing Sheets

BOOSTER SEAT APPARATUS

FIELD OF THE INVENTION

This invention relates to a booster seat apparatus and, in particular, to an invertible booster seat that is particularly suited for use by children in movie theaters, auditoriums and similar applications.

BACKGROUND OF THE INVENTION

Small children often experience considerable difficulty sitting in standard movie theater or auditorium seats. Such seats are designed to comfortably seat adults and older children at an appropriate height for viewing the movie screen, stage, podium etc. However, a small child is often blocked by the seat back or person located in front of him or her. As a result, the child may become restless, fidget and disrupt others around him. In order to reach a comfortable height, the child may have to stand or be held up by an older child or adult. This is likely to be uncomfortable for the child and annoying to others in the theater.

At present, a number of childrens' booster seats are known. Typically, such seats are employed in conjunction with high chairs and car seats. However, none of the presently available booster seats are suited for use by children in movie theaters and auditoriums. In particular, all such seats include some type of seat back. As a result, they do not usually provide a very good fit with the theater seat. Moreover, many known booster seats are relatively bulky and may require some type of attachment to the underlying chair. As a result, they are quite inconvenient for use in a theater or auditorium. Another problem that is presented when small children attend a movie theater is the mess that often results from spilled snack and drink items. Conventional childrens' booster seats do nothing to remedy this problem because none has the capacity for storing the types of refreshment items that a child often handles in a movie theater.

SUMMARY OF INVENTION

It is therefore an object of this invention to provide a booster seat apparatus that is particularly suited for use by children in movie theaters and auditoriums.

It is a further object of this invention to provide a booster seat apparatus that employs the seat back of the underlying chair as the back of the booster seat.

It is a further object of this invention to provide a booster seat apparatus that is invertible so that the height of the booster seat may be adjusted as required.

It is a further object of this invention to provide a booster seat apparatus that includes convenient receptacles for holding food and drink refreshments.

It is a further object of this invention to provide a booster seat apparatus that is quick and convenient to set up, collect and store.

It is a further object of this invention to provide a booster seat apparatus that may be quickly and conveniently cleaned between uses.

This invention results from a realization that a child may be conveniently and comfortably supported at an appropriate height on a movie theater or auditorium chair (hereinafter referred to as theater chair) by employing a booster seat apparatus that has a substantially fully open back region and a convexly curved rearward edge portion that engages the curved seat back of the theater chair. Such a structure permits the booster seat to conformably engage the seat back of the theater chair so that the latter serves to support the back of a child seated on the booster seat.

This invention features a booster seat for a chair having a supporting seat and a laterally curved seat back. The booster seat includes a pair of spaced apart side supports, each having a first support portion for engaging the supporting seat and a second support portion for defining an arm rest. A seat section interconnects the side supports between the first and second support portions for supporting a person thereon. The seat section has a convexly curved rearward edge portion for engaging the curved seat back of the chair. A substantially fully opened back region is formed above the seat section and between the second support sections for cooperating with the curved seat back of the chair to define a seat back for the person supported by the seat section.

In a preferred embodiment the side supports are invertible such that the second support portions engage the supporting seat and the first support portions define arm rests. The seat section preferably has a first seat surface for supporting a person thereon when the first support portions engage the supporting seat and an opposite second seat surface for supporting a person thereon when the second support portions engage the supporting seat. A substantially fully opened first back region is formed adjacent the first seat surface and between the second side support portions for cooperating with the curved seat back of the chair to define a seat back for persons seated on the first seat surface. A substantially fully open second back region is formed adjacent the second seat surface and between the first side support portions for cooperating with the curved seat back of the chair to define a seat back for a person seated on the second seat surface.

The first support portions may extend transversely from the second seat surface and the second support portions may extend transversely from the first seat surface. The first support portions and the second support portions typically have unequal lengths. At least one of the first and second support portions may include receptacle means for accommodating a refreshment item therein. The receptacle means may include a peripheral wall and a slot formed in the peripheral wall to facilitate access to the receptacle means for cleaning.

The side support portion and the seat section are preferably integrally connected. The first and second seat surfaces may include a contour that generally conforms to a person seated on the seat section. Each seat surface may include a rearward edge region and a forward region that include substantially equal heights. The seat section may include a handle portion defined by an opening formed therein proximate a forward edge of the seat portion. The side support sections and the seat section may include a phosphorescent material.

A plurality of seat apparatuses may be provided according to this invention. The first support portions may carry insertion means and the second support portions may include slot means for receiving the insertion means carried by the first support portion of an adjacent seat apparatus to permit a pair of the seat apparatuses to be stacked together.

DISCLOSURE OF PREFERRED EMBODIMENTS

Other objects, features and advantages will occur from the following description of preferred embodiments and the accompanying drawings, in which.

Figure 1:
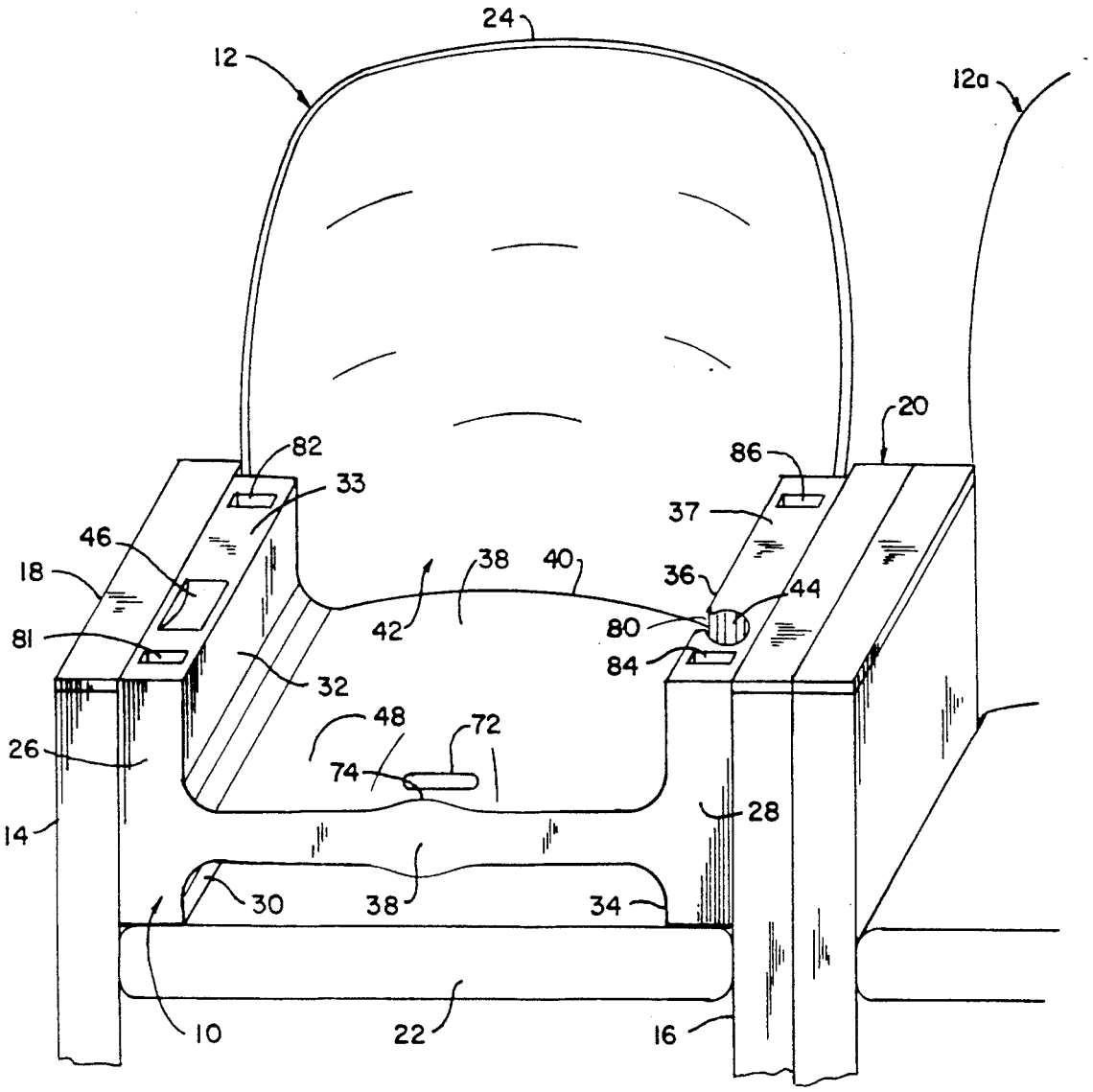
FIG. 1 is a perspective view of a booster seat apparatus, according to this invention, disposed on a theater chair for supporting a child thereon.

There is shown in FIG. 1 an invertible booster seat apparatus 10 that is operably mounted on a theater chair 12. The theater chair is a conventional item, which includes a pair of spaced apart legs 14 and 16 that carry respective armrests 18 and 20. A cushioned seat 22 is pivotably mounted to legs 14 and 16 such that it can be lowered for seating purposes and raised between uses. A laterally concave and typically cushioned seat back 24 is permanently secured in a conventional manner to the legs. Additional theater chairs 12, one of which is partially shown, are arranged in rows in the theater in a known manner.

Apparatus 10 is selectively mounted on lowered seat 22 in order to support a child at a comfortable height in chair 12. Apparatus 10 includes a pair of spaced apart side supports 26 and 28. Side support 26 includes a first support portion 30 that engages seat 22 and a second support portion 32 that defines an armrest for a child seated in apparatus 10. Similarly, side support 28 includes a first support section 34, which engages supporting seat 22, and a second support section 36, which defines a second armrest.

A seat section 38 integrally interconnects side supports 26 and 28. The seat section serves to support a child in an elevated position above seat 22 of theater chair 12. As is described more fully below, seat section 38 has a contour that generally conforms to the child so that he or she is comfortably supported. The seat section includes a convexly curved rearward edge 40 that generally conformably engages the concavely curved seat back 24 of chair 12. A fully open back region 42 is formed above the seat section 38 and between side supports 26 and 28. As a result, the permanent seat back 24 of chair 12 forms the seat back for a child seated on apparatus 10.

Various receptacles, including a cup holder 44 and a candy holder 46, are formed in substantially horizontal upper surfaces 33 and 37 of support sections 32 and 36, respectively. The construction and use of these recesses is described more fully below. Surfaces 33 and 37 are generally flush with respective armrest portions 18 and 20 of chair 12, although this is not necessary.

Figure 2:
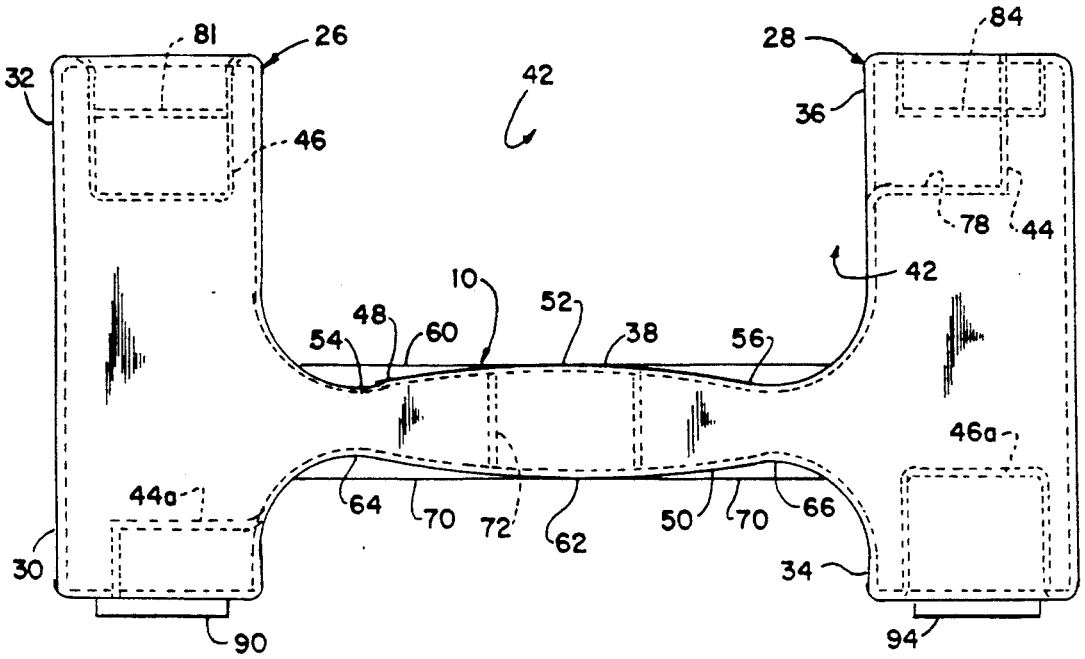
FIG. 2 is a plan view of the booster seat apparatus.
Figure 3:
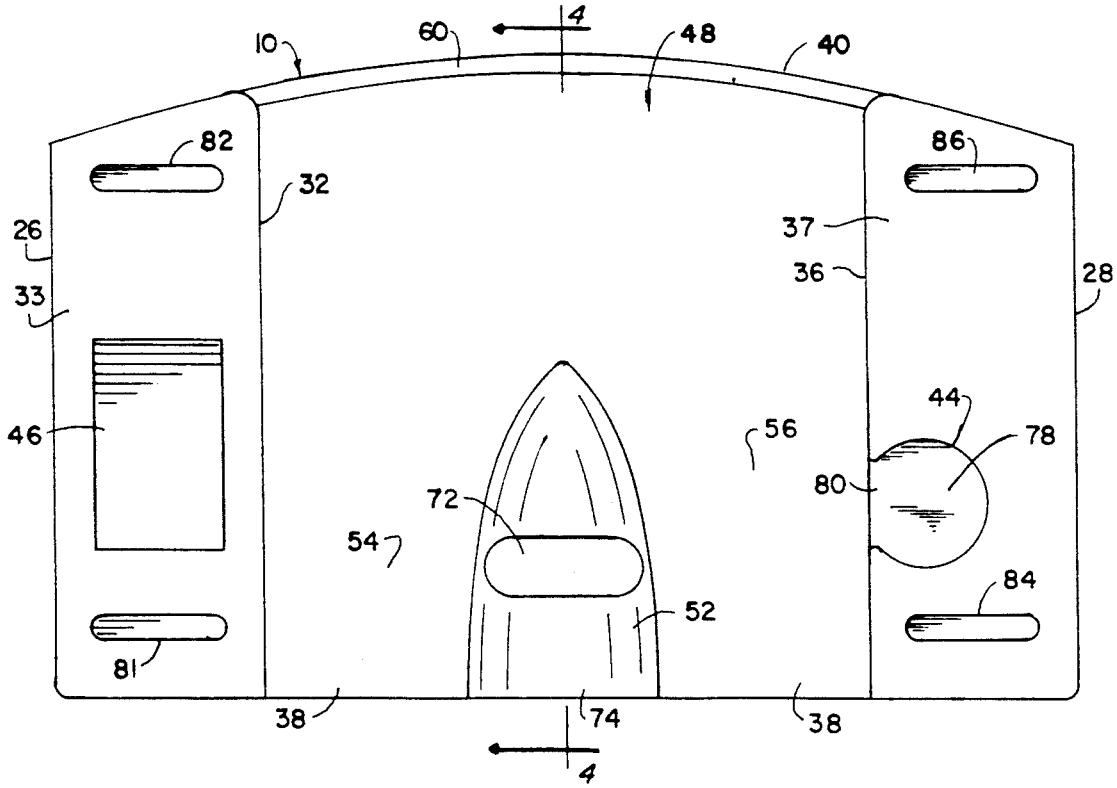
FIG. 3 is an elevational front view of the booster seat apparatus.
Figure 4:
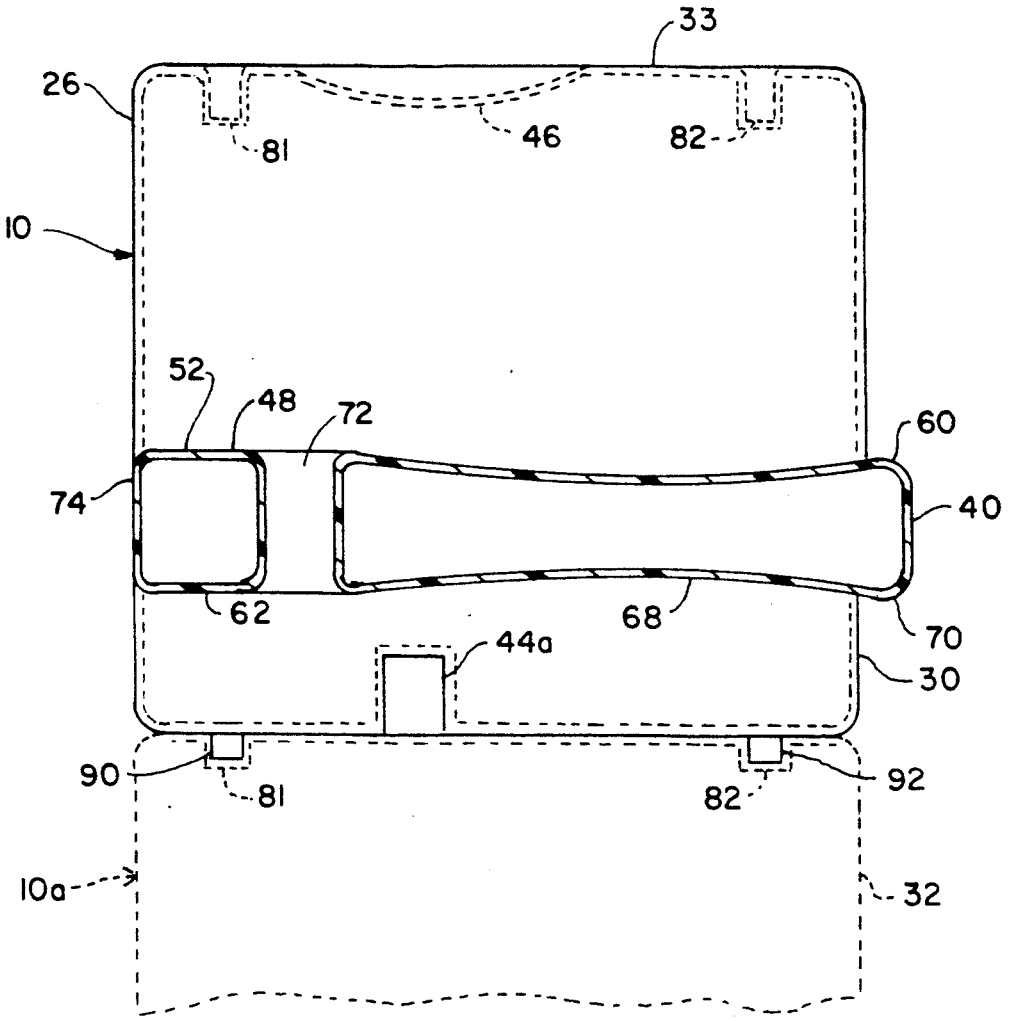
FIG. 4 is a cross sectional view taken along line 4—4 of FIG. 3.

Apparatus 10 is shown alone in FIGS. 2–4. The booster apparatus is composed of a lightweight, yet durable molded plastic. Various alternative materials that include woods and metals may also be utilized. Nonetheless, a molded plastic is relatively convenient to manufacture, transport and clean. Easy cleaning is particularly important because the booster apparatus is intended for use primarily by small children. During the molding process phosphorescent material may be added to the plastic so that the booster apparatus is visible in a darkened theater. An appropriate logo may be molded into one or more of the outside vertical surfaces of side supports 26 and 28.

As best illustrated in FIG. 2, seat section 38 is interconnected between side supports 26 and 28 in a generally H-shaped configuration. The seat section includes a first generally upwardly facing first seat surface 48 and an opposite, generally downwardly facing second seat surface 50. Second support portions 32 and 36 extend upwardly from seat surface 48 and first support portions 30 and 34 extend downwardly from seat surface 50. First support portions 30 and 34 are somewhat shorter than second support portions 32 and 36. For example, first support portions 30 and 34 may be 1½ in length and support portions 32 and 36 may be 4½ long. These distances are illustrative, however, and are not intended as limitations of the invention. Each of the corners formed in the side supports and seat section are rounded so that the risk of injury to children seated on the booster seat is reduced.

Apparatus 10 is invertible so that a person may be seated on a selected one of seat surfaces 48 or 50. In FIGS. 1 and 2 seat surface 48 is shown facing upwardly. As a result, a child seated thereon is elevated above the theater supporting seat 22 at a height determined by the length of side support portions 30 and 34 (e.g. 1½") and the thickness of seat section 38. For smaller children, apparatus 10 is inverted. As a result, second side support portions 32 and 36 engage theater seat 22. First side support portions 30 and 34 define armrests and seat surface 50 faces upwardly to support the child thereon. With the booster seat in this position, the child is held at a height determined by the length of the second support portions 32 and 36 (e.g. 4½") and the thickness of seat section 38. Accordingly, an additional 3" of elevation is provided, which more effectively boosts smaller children.

Each of seat surfaces 48 and 50 is contoured to generally conform to a person seated thereon. In particular, seat surface 48 includes a convexly curved central region 52 and a pair of relatively recessed regions 54 and 56 formed on either side thereof. As best illustrated in FIG. 4, seat surface 48 extends rearwardly in a smooth manner and is slightly concave from front to rear so that a child may be comfortably seated thereon. A rearward edge region 60 of seat surface 48 is slightly raised, although it does not extend above the height of convex region 54. A child sits upon surface 48 such that his or her legs extend through recessed sections 54 and 56 and straddle convex region 52. As a result, the child is held securely in place and is prevented from sliding forwardly and falling off the booster seat. At the same time, back region 42, FIGS. 1 and 2, is fully open so that the child's back comfortably engages the seat back of the theater chair.

A similar construction is provided for second seat surface 50. In particular, as illustrated in FIGS. 2 and 4, the second seat surface includes a convex central region 62 and adjacent recessed regions 64 and 66 for accommodating the child's legs. The child's buttocks engages the slightly concave region 68, which terminates at a slightly raised rearward edge region 70. Again, the height of edge region 70 is no greater than the height of convex forward region 62.

A slot 72 is formed through seat section 38 between seat surfaces 48 and 50. This slot defines a handle 74 in the seat section that enables apparatus 10 to be quickly and conveniently lifted and carried from the seat when the apparatus is not in use.

As best shown in FIG. 3, molded receptacle 44 has a generally circular shape for accommodating a cup, soda can or other drink container. This receptacle includes a bottom surface 78 that is formed at a depth of approximately 2.75". A slot 80 is formed into receptacle 44 through the inside wall of support section 36. This slot enables receptacle 44 to be conveniently cleaned by a sponge, paper towel or other means. An analogous receptacle 44*a*, FIGS. 2 and 4, is formed in side support portion 30. Accordingly, when the booster apparatus is inverted and side support portion 30 defines an armrest, receptacle 44*a* is positioned for convenient use by the child seated on the seat surface 50 of the booster seat.

Figure 5:
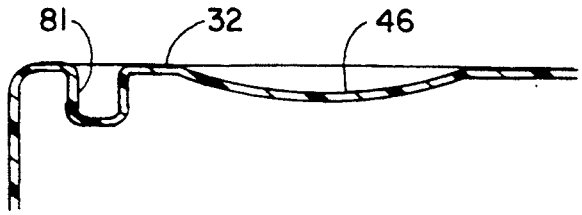
FIG. 5 is a view of the snack receptacle formed in the side support of the booster seat.

Recess 46 formed in surface 33 of side support portion 32 is designed for holding candy and other snack items, either in a box or loosely. It includes a generally rectangular shape and, as best shown in FIGS. 4 and 5, a bottom having a concave contoured shape. This shape provides small children with easy access to the items contained in receptacle 46 and permits convenient cleaning of the receptacle because hard to clean corners are eliminated. Again, an analogous snack receptacle 46*a*, FIG. 2, is formed in the horizontal surface of side support portion 34. As a result, when booster apparatus 10 is inverted, receptacle 46*a* is positioned upwardly for use.

Means are provided for stackably interconnecting a plurality of booster seats 10. In particular, as illustrated in FIGS. 1-3, upper surface 33 of side support portion 32 includes a first slot 81 disposed forwardly of recess 46 and a second similar slot 82 disposed rearwardly of the recess. Likewise, upper surface 37 of side support portion 36 includes a forward slot 84 and a rearward slot 86. A plurality of complementary insertion elements are formed on the horizontal surfaces of side support portions 30 and 34. In particular, as shown in FIGS. 2 and 4, a molded insertion element 90 is formed forwardly of receptacle 44*a* and an insertion element 92 is formed proximate the rearward end of support portion 30. Likewise, an insertion element 94 is carried by the horizontal surface of support portion 34 proximate the front end thereof. A similar insertion member, not shown, is carried by support portion 34 proximate the back end thereof. Each of the insertion elements corresponds in size, shape and location to a respective one of the slots 81, 82, 84 and 86. Accordingly, as shown in FIG. 4, insertion elements 90 and 92 in support portion 30 are received by corresponding slots 81 and 82 in the support portion 32 of a second booster assembly 10*a*, shown in phantom. Similarly, the insertion elements carried by support portion 34, FIG. 2, are received by the slots 84 and 86, FIG. 3, in the support portion 36 of adjacent underlying booster apparatus 10*a*. Accordingly, a plurality of booster apparatuses may be stacked and held securely together in the manner shown in FIG. 4.

Although the booster seat apparatus 10 is disclosed as being used for theater seats, this is not a limitation of the invention. In alternative embodiments the booster seat may be utilized for various other types of chairs and seats having a laterally curved seat back. Moreover, although the booster seat preferably is invertible and includes upper and lower seat surfaces, in alternative embodiments a single seat surface may be employed. In such embodiments a base or similar structure may be employed beneath the seat. Nonetheless, in all embodiments of this invention a substantially fully open back region and curved rearward edge are utilized to provide the user with comfortable support that takes advantage of the curved back of the existing chair or seat.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. An invertible booster seat apparatus for use with a chair having a supporting seat and a laterally concavely curved seat back, said booster seat comprising:

a pair of spaced apart side supports, each having a first support portion for engaging the supporting seat and a second support portion for defining an armrest, said side supports being invertible such that said second support portions engage said supporting seat and said first support portions define armrests;

a seat section that interconnects said side supports between said first support portions and said second support portions, said seat section having a first seat surface for supporting a person thereon when said first support portions engage said supporting seat and an opposite second seat surface for supporting a person thereon when said second support portions engage said support seat; said seat section further having a horizontally, convexly curved rearward edge for conformably engaging the laterally concavely curved seat back of the chair;

each said seat surface having a raised rim portion formed along said rearward edge and having a height that is less than the height of said side supports;

a substantially fully open first back region formed adjacent said first seat surface and between said second side support portions for cooperating with said curved seat back of said chair to define a seat back for a person seated on said first seat surface; and a substantially fully open second back region formed adjacent said second seat surface and between said first side support portions for cooperating with said curved seat back of said chair to define a seat back for a person seated on said second seat surface.

2. The apparatus of claim 1 in which said first support portions extend transversely from said second seat surface and said second support portions extend transversely from said first seat surface.

3. The apparatus of claim 2 in which said first support portions and said second support portions have unequal lengths.

4. The apparatus of claim 1 in which at least one of said first and second support portions includes a receptacle for accommodating refreshments therein.

5. The apparatus of claim 4 in which said receptacle includes a peripheral wall and a slot formed in said peripheral wall to facilitate access to said receptacle for cleaning.

6. The apparatus of claim 1 in which said side supports and said seat section are integrally interconnected.

7. The apparatus of claim 1 in which each said seat surface includes a convex forward region that has an elevation which is at least as great as said rim portion.

8. The apparatus of claim 1 in which said seat section includes a handle portion defined by an opening formed therein proximate a forward edge of said seat section.

9. An apparatus according to claim 1, further including means carried by said first and second support portion for interengaging complementary means carried by an adjacent said apparatus to permit a pair of said seat apparatuses to be stacked together.

10. The apparatus of claim 1 in which said side supports and said seat section include a phosphorescent material.

11. The apparatus of claim 1 in which said side supports and said seat section comprise a one-piece molded construction.

* * * * *